US010247449B2

(12) United States Patent
Zhao et al.

(10) Patent No.: US 10,247,449 B2
(45) Date of Patent: Apr. 2, 2019

(54) VARIABLE-CAPACITY COMPRESSOR, TWO-STAGE COMPRESSION SYSTEM AND CONTROL METHOD THEREOF

(71) Applicant: Gree Electric Appliances, Inc. of Zhuhai, Zhuhai (CN)

(72) Inventors: Huan Zhao, Zhuhai (CN); Jun Shen, Zhuhai (CN); Feng Tan, Zhuhai (CN); Youxuan Liang, Zhuhai (CN); Pengfei Li, Zhuhai (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 0 days.

(21) Appl. No.: 15/991,553

(22) Filed: May 29, 2018

(65) Prior Publication Data

US 2018/0274822 A1 Sep. 27, 2018

Related U.S. Application Data

(63) Continuation of application No. PCT/CN2016/102575, filed on Oct. 19, 2016.

(30) Foreign Application Priority Data

Dec. 28, 2015 (CN) ..... 2015 1 1017313

(51) Int. Cl.
*F04B 1/00* (2006.01)
*F25B 1/10* (2006.01)
(Continued)

(52) U.S. Cl.
CPC ..... *F25B 1/10* (2013.01); *F04B 1/00* (2013.01); *F04B 27/00* (2013.01); *F04B 49/03* (2013.01); *F04B 49/06* (2013.01); *F04B 49/22* (2013.01); *F24F 1/10* (2013.01); *F25B 31/00* (2013.01); *F25B 41/04* (2013.01); *F25B 49/022* (2013.01); *F04B 2207/03* (2013.01); *F24F 2221/54* (2013.01); *F25B 13/00* (2013.01); *F25B 41/043* (2013.01); *F25B 2400/074* (2013.01);
(Continued)

(58) Field of Classification Search
CPC .... F24F 1/10; F25B 1/10; F25B 41/04; F25B 31/00; F25B 2400/23; F25B 2400/075
See application file for complete search history.

(56) References Cited

U.S. PATENT DOCUMENTS

2007/0039347 A1 2/2007 Robertson et al.
2011/0165004 A1* 7/2011 Park ..... F04C 18/3564 418/5

FOREIGN PATENT DOCUMENTS

CN 101389867 A 3/2009
CN 103335438 A 10/2013
(Continued)

*Primary Examiner* — Ana M Vazquez
(74) *Attorney, Agent, or Firm* — The Webb Law Firm

(57) ABSTRACT

The present disclosure provides a variable-capacity compressor, a variable-capacity two-stage compression system and a control method thereof. The compression system includes a compressor, wherein the compressor includes a low pressure cylinder and a high pressure cylinder connected in series, wherein the low pressure cylinder includes at least two cylinders connected in parallel. The compression system further includes a control mechanism that can control at least one of the at least two cylinders connected in parallel to perform full-load and/or no-load operation.

12 Claims, 3 Drawing Sheets

(51) Int. Cl.

| | |
|---|---|
| ***F24F 1/10*** | (2011.01) |
| ***F25B 31/00*** | (2006.01) |
| ***F25B 41/04*** | (2006.01) |
| ***F04B 27/00*** | (2006.01) |
| ***F04B 49/03*** | (2006.01) |
| ***F04B 49/06*** | (2006.01) |
| ***F04B 49/22*** | (2006.01) |
| ***F25B 49/02*** | (2006.01) |
| *F25B 13/00* | (2006.01) |

(52) U.S. Cl.
CPC ..... *F25B 2400/075* (2013.01); *F25B 2400/13* (2013.01); *F25B 2400/23* (2013.01)

(56) References Cited

FOREIGN PATENT DOCUMENTS

| | | | | | |
|---|---|---|---|---|---|
| CN | 103954066 | A | * | 7/2014 | ..... F25B 1/00 |
| CN | 105466060 | A | | 4/2016 | |
| CN | 205261965 | U | | 5/2016 | |

* cited by examiner

VARIABLE-CAPACITY COMPRESSOR, TWO-STAGE COMPRESSION SYSTEM AND CONTROL METHOD THEREOF

CROSS-REFERENCE TO RELATED APPLICATIONS

This application is a United States continuation of International Application No. PCT/CN2016/102575 filed Oct. 19, 2016, which claims priority to Chinese Patent Application No. 201511017313.9 filed Dec. 28, 2015, the disclosures of which are hereby incorporated in their entirety by reference.

TECHNICAL FIELD

The present disclosure relates to the field of air conditioning, and in particular relates to a variable-capacity compressor, a variable-capacity two-stage compression system and a control method thereof.

BACKGROUND

The lower the ambient temperature is, the higher the demand for the heat capacity of an air conditioner is. However, current heat pump with single-stage compression can only be started normally for operation at −20° C. (outdoor ambient temperature) or above. Further, the heat capacity is seriously attenuated, thus the heating effect cannot be guaranteed, and reliability of the unit also undergoes a severe test.

Compared with the heat pump with single-stage compression, a two-stage compression system with enhanced vapor injection has a greater heat capacity and a higher energy efficiency at low temperature. Further, the two-stage compression system can reduce the pressure ratio of the single-stage compressor and reduce exhaust temperature, and can meanwhile increase suction efficiency and compression efficiency to thereby increase the heat capacity and the heating efficiency.

In the related two-stage compressor, as the volume of the high pressure cylinder and the volume of the low pressure cylinder are fixed, their volume ratio is a fixed value, and thus the ratio of the displacement of the high pressure stage to that of the low pressure stage of the compressor is fixed. However, any compressor with a fixed ratio of displacement has only one highest value of energy efficiency at a specific working condition, and with a variation in air-conditioning load, energy efficiency varies greatly, resulting in unideal economic performance. On the other hand, under the nominal refrigeration conditions, the optimal compression ratio of the high pressure stage to the low pressure stage of the two-stage compression system is around 0.9, whereas under the low-temperature heating condition, the compression ratio of the high pressure stage to the low pressure stage is optimally around 0.6. Therefore, the two-stage compression system with a fixed compression ratio cannot simultaneously meet the energy efficiency requirements for refrigeration and heating.

The related two-stage compression system can only achieve a variation in displacement ratio of the high pressure stage to the low pressure stage by series connection of two inverter compressors, in which the system is complicated and high in costs, and oil return is low in reliability.

SUMMARY

Embodiments of the present disclosure provide a variable-capacity two-stage compression system comprising: a compressor, wherein the compressor comprises a low pressure cylinder and a high pressure cylinder in series connection, wherein the low pressure cylinder comprises at least two cylinders in parallel connection; and a control mechanism that controls at least one of the at least two cylinders in parallel connection to perform full-load and/or no-load operation.

Optionally, there is one high pressure cylinder provided, which is a third cylinder, and two low pressure cylinders are provided, comprising a first cylinder and a second cylinder.

Optionally, the first cylinder can operate in two operation modes of no-load operation or full-load operation, while the second cylinder and the third cylinder always operate in full load.

Optionally, when the first cylinder is no-loaded, of the low pressure cylinder, only the second cylinder is working, and a refrigerant passes through the second cylinder to be compressed before being mixed with an intermediate jet gas, and finally enters the third cylinder for second stage compression.

Optionally, when the first cylinder is fully-loaded, the first cylinder and the second cylinder in the low pressure cylinder are both working, and the refrigerant enters the first cylinder and the second cylinder to be compressed respectively, then is mixed with the intermediate jet gas, and finally enters the third cylinder for second stage compression.

Optionally, the control mechanism comprises a pipeline structure communicating with a suction port of the low pressure cylinder, and a solenoid valve structure disposed on the pipeline structure.

Optionally, when the low pressure cylinder comprises the first cylinder and the second cylinder, the pipeline structure comprises a first pipeline that communicates with a suction port of the first cylinder, and a second pipeline that communicates with a suction port of the second cylinder.

Optionally, the solenoid valve structure comprises a first solenoid valve disposed on the first pipeline, and a second solenoid valve disposed on the second pipeline.

Embodiments of the present disclosure further provide a variable-capacity two-stage compression control method which performs variable-capacity two-stage compression control and adjustment to the aforementioned variable-capacity two-stage compression system by means of the aforesaid control mechanism.

Optionally, when the control mechanism comprises the first solenoid valve and the second solenoid valve, in the case where the system needs to operate in two-cylinder mode, the first solenoid valve is opened and the second solenoid valve is closed, so that the first cylinder of the compressor is in no-load operation; and at this time, the compression system enters the two-cylinder operation mode.

Optionally, when the control mechanism comprises the first solenoid valve and the second solenoid valve, in the case where the system needs to operate in three-cylinder mode, the second solenoid valve is opened and the first solenoid valve is closed, so that the first cylinder of the compressor is in full-load operation; and at this time, the compression system enters the three-cylinder operation mode.

Optionally, the opening and/or closing of the first solenoid valve and/or the second solenoid valve is controlled according to the conditions of the unit load and the indoor and outdoor ambient temperature.

Optionally, when the system is in refrigerating operation, an operating action is performed after an outdoor ambient temperature and an indoor unit load rate are determined: when the outdoor ambient temperature and the indoor unit load are relatively low, the first solenoid valve is opened and the second solenoid valve is closed, and in this instance, the compressor operates in the two-cylinder mode; when the outdoor ambient temperature and the indoor unit load are relatively high, the first solenoid valve is opened and the second solenoid valve is closed, and in this instance, the compressor operates in the three-cylinder mode.

Optionally, when the system is in heating operation, an operating action is performed after an outdoor ambient temperature and an indoor unit load rate are determined: when the outdoor ambient temperature is relatively high and the indoor unit load rate is relatively low, the first solenoid valve is opened and the second solenoid valve is closed, and in this instance, the compressor operates in the two-cylinder mode; when the outdoor ambient temperature is relatively low and the indoor unit load rate is relatively high, the second solenoid valve is opened and the first solenoid valve is closed, and in this instance, the compressor operates in the three-cylinder mode.

Figure 1A:
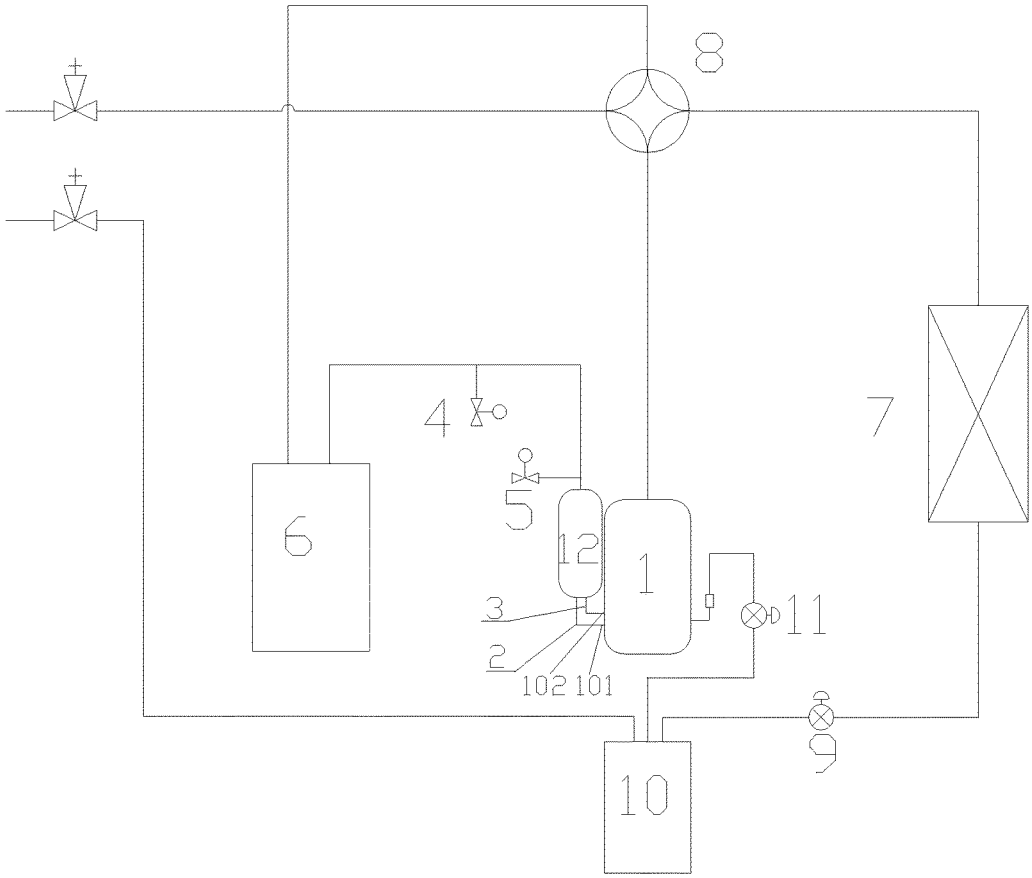
FIG. 1A is a schematic structural view of the variable-capacity two-stage compression system in some embodiment of the present disclosure.

The reference signs in the drawings are denoted as follows:

1—Compressor; 101—suction port of the first cylinder; 102—suction port of the second cylinder; 2—first pipeline; 3—second pipeline; 4—first solenoid valve; 5—second solenoid valve; 6—gas-liquid separator; 7—outdoor heat exchanger; 8—four-way valve; 9—electronic expansion valve 1; 10—flash evaporator; 11—electronic expansion valve 2 (air admission valve); 12—compressor self-carried gas-liquid separator; 111—first-stage compression first cylinder; 112—first-stage compression second cylinder; 113—intermediate chamber; 114—second-stage compression cylinder; 115—first-stage compression exhaust channel; 116—first-stage compression cylinder slide control mechanism; 20—suction pipe; 21—exhaust pipe; 22—air admission pipe; 23—variable-capacity pipe.

DETAILED DESCRIPTION

As the two-stage compression system in the related art has the technical problems of large variation in energy efficiency, unideal economic performance, and a fixed compression ratio being unable to meet the energy efficiency requirements for refrigeration and heating at the same time, embodiments of the present disclosure provide a variable-capacity two-stage compression system and control method thereof.

Embodiments of the present disclosure may provide a variable-capacity two-stage compression system and control method thereof so as to overcome the defects of large variation in energy efficiency, unideal economic performance, and a fixed compression ratio being unable to meet the energy efficiency requirements for refrigeration and heating at the same time, that exist in the two-stage compression system of the related art.

As shown in FIG. 1, an embodiment of the present disclosure provides a variable-capacity two-stage compression system comprising: a compressor, wherein the compressor comprises a low pressure cylinder and a high pressure cylinder in series connection, wherein the low pressure cylinder comprises at least two cylinders connected in parallel; and a control mechanism that controls at least one of the at least two cylinders connected in parallel to perform full-load or no-load operation.

The such-configured structure can achieve a variation in displacement ratio (or volume ratio) of the high pressure stage to the low pressure stage in a single compressor. Compared with a system in which two compressors are connected in series, embodiments of the present disclosure have a smaller variation in energy efficiency, can simultaneously meet the energy efficiency requirements for refrigeration and heating, and greatly increases the economic performance. Further, embodiments of the present disclosure are simpler in structure and lower in cost, and are free of the problem that two compressors are oil imbalanced. Moreover, the operating temperature range and operating efficiency can be increased, and the reliability of a two-stage compression system can be improved as well, thereby significantly improving the economic performance of the two-stage compression system.

Figure 1B:
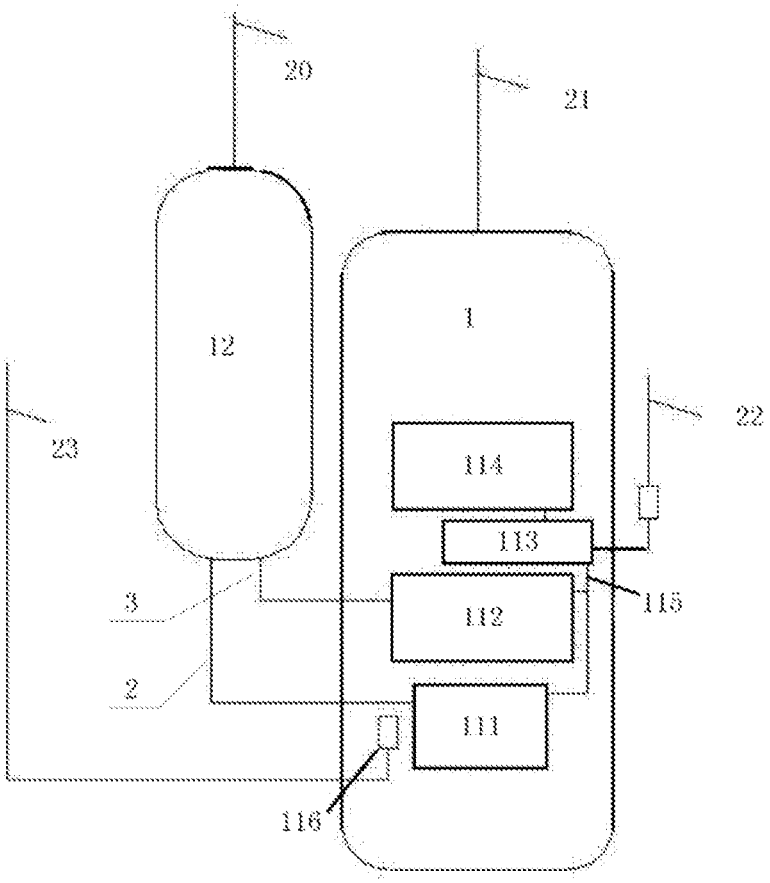
FIG. 1B is a schematic structural view of the variable-capacity compressor in some embodiment of the present disclosure.

Optionally, there is one high pressure cylinder provided, which is a third cylinder, wherein two low pressure cylinders are provided, comprising a first cylinder and a second cylinder. As shown in FIG. 1B which is a schematic structural view of a variable-capacity compressor in some embodiment of the present disclosure, the variable-capacity compressor comprises a compressor 1 comprising two lower pressure cylinders connected in parallel, i.e. a first-stage compression first cylinder 111 and a first-stage compression second cylinder 112, both of which are connected to an intermediate chamber 113 through a first-stage compression exhaust channel 115, and are serially connected to a high pressure cylinder, i.e. a second-stage compression cylinder 114. The first-stage compression first cylinder 111 and the first-stage compression second cylinder 112 are connected to a compressor self-carried gas-liquid separator 12 through first-stage compression suction channels 2 and 3 (i.e. a first pipeline 2 and a second pipeline 3); the compressor self-carried gas-liquid separator 12 is connected to a suction pipe 20; the intermediate chamber 113 of the compressor 1 is connected to an air admission pipe 22; and the variable-capacity pipe 23 is connected to a first-stage compression cylinder slide control mechanism 116 for controlling the first-stage compression first cylinder 111 in no-load operation or full-load operation.

This is a preferred structure and embodiment of the cylinders of the compressor, which can achieve a variation in displacement ratio of the high pressure stage to the low pressure stage and a small variation in energy efficiency, and can meet the energy efficiency requirements for refrigeration and heating and improve economic performance by making adjustment to the first and second cylinders connected in parallel according to different actual demands in combination with the third cylinder as the high pressure cylinder.

Optionally, the first cylinder can operate in two operation modes of no-load operation or full-load operation, while the second cylinder and the third cylinder always operate in full load. This is a preferred embodiment, which can effectively ensure normal operation of the two-stage compression by ceaseless full-load operation of the second cylinder and the third cylinder, and can switch the compressor between the two-cylinder mode and the three-cylinder mode to achieve a variation in displacement ratio of the high pressure stage to the low pressure stage by adjusting the first cylinder to perform no-load operation or full-load operation, thereby attaining the purpose of providing the system with a small variation in energy efficiency and enabling it to simultaneously meet the energy efficiency requirements for refrigeration and heating.

Optionally, when the first cylinder is no-loaded, of the low pressure cylinder (also referred to as lower pressure stage), only the second cylinder is working, and a refrigerant passes through the second cylinder to be compressed before being mixed with an intermediate jet gas, and finally enters the third cylinder for second stage compression. At this time, the displacement ratio of the high pressure stage to the low pressure stage is relatively large (the displacement ratio is the volume ratio of the two cylinders), which is assumed to be a herein. This operation mode is suitable for use in conditions with small load and is called two-cylinder mode.

Optionally, when the first cylinder is fully-loaded, the first cylinder and the second cylinder in the low pressure cylinder (also referred to as lower pressure stage) are both working, and the refrigerant enters the first cylinder and the second cylinder (from the gas-liquid separator 6) to be compressed respectively, then is mixed with the intermediate jet gas, i.e. the refrigerant after being compressed by the lower pressure cylinders is mixed with the intermediate jet gas, and finally enters the third cylinder (i.e. the high pressure cylinder) for second stage compression. At this time, the displacement ratio of the high pressure stage to the low pressure stage is relatively small, which is assumed to be b herein. This operation mode is suitable for use in conditions with large load and is called three-cylinder mode.

Optionally, the control mechanism comprises a pipeline structure communicating with a suction port of the low pressure cylinder, and a solenoid valve structure disposed on the pipeline structure. The pipeline structure can be used to achieve the purpose of feeding the refrigerant to the low pressure cylinders, and the solenoid valve structure can be used to adjust the refrigerant in the pipelines as actually required to attain the purpose of switching between the two-cylinder mode and the three-cylinder mode.

Optionally, when the low pressure cylinder comprises the first cylinder and the second cylinder, the pipeline structure comprises a first pipeline 2 that communicates with a suction port 101 of the first cylinder, and a second pipeline 3 that communicates with a suction port 102 of the second cylinder. The first line communicating with the suction port of the first cylinder enables the refrigerant to enter the suction port of the first cylinder, and the second line communicating with the suction port of the second cylinder enables the refrigerant to enter the suction port of the second cylinder, thereby achieving the purpose of feeding the refrigerant to the cylinders.

Optionally, the solenoid valve structure comprises a first solenoid valve 4 disposed on the first pipeline 2, and a second solenoid valve 5 disposed on the second pipeline 3. The first solenoid valve and the second solenoid valve provided on the above pipelines can effectively open or close the refrigerant in the pipelines to play an effective control role.

The adjustment to opening and closing of the first solenoid valve 4 and the second solenoid valve 5 can achieve a variation in the displacement ratio of the high pressure stage to the low pressure stage of the variable-capacity two-stage compressor.

Embodiments of the present disclosure provide a two-stage compression heat pump system which can achieve a variation in the displacement ratio of the high pressure stage to the low pressure stage. This system can, on one hand, accomplish two-stage compression operation with high compression ratio, having high operation efficiency in the case of small system load or low requirement for capacity of the indoor unit, and on the other hand, can also accomplish two-stage compression with low compression ratio, and also has a high operation efficiency in the case of large system load or high requirement for capacity of the indoor unit. Embodiments of the present disclosure not only broaden the refrigeration and heating operating temperature range of the unit, but also greatly improve the high-temperature refrigeration and the low-temperature heating efficiency compared with the related secondary compression system; in particular, the heat capacity at low temperature of the present disclosure is significantly increased, and the unit is endowed with high heating capacity and heating efficiency at the ambient environment of −20° C. or below, fully guaranteeing the comfort and economic performance during low-temperature heating operation.

Embodiments of the present disclosure further provide a variable-capacity two-stage compression control method which performs variable-capacity two-stage compression control and adjustment to the aforementioned variable-capacity two-stage compression system by means of the aforesaid control mechanism. With the adoption of the aforementioned variable-capacity two-stage compression system, a variation in displacement ratio (or volume ratio) of the high pressure stage to the low pressure stage can be achieved in a single compressor. Compared with the system in which two compressors are connected in series, embodiments of the present disclosure have a smaller variation in energy efficiency, can simultaneously meet the energy efficiency requirements for refrigeration and heating, and greatly increase the economic performance of a system. Further, it is simpler in structure and lower in cost, and is free of the problem that two compressors are oil imbalanced. Moreover, the operating temperature range and operating efficiency of a system can be increased, and the reliability of a two-stage compression system can be improved as well, thereby significantly improving the economic performance of the two-stage compression system.

Optionally, when the control mechanism comprises the first solenoid valve and the second solenoid valve, in the case where the system needs to operate in two-cylinder mode, the first solenoid valve 4 is opened and the second solenoid valve 5 is closed, so that the first cylinder of the compressor is in no-load operation, and at this time, the compression system enters the two-cylinder operation mode (this system adopts a compressor in which the switching of a cylinder is accomplished by mechanical means, i.e. mainly using pressure of the refrigerant to control the internal components of the compressor to achieve the full-load and no-load of the cylinder. The first solenoid valve 4 and the second solenoid valve 5 just function to introduce and discharge pressure so as to control the full-load and no-load of the cylinder. The refrigerant in the pipelines of the first solenoid valve and the second solenoid valve flows only at the moment of opening and closing the valves, and then is in a stationary state. The refrigerant in the pipelines of the first and second solenoid valves cannot enter the compressor to be compressed. The above also applies to contents below), thereby achieving the adjustment to two-cylinder operation mode.

Optionally, when the control mechanism comprises the first solenoid valve and the second solenoid valve, in the case where the system needs to operate in the three-cylinder mode, the second solenoid valve 5 is opened and the first solenoid valve 4 is closed, so that the first cylinder of the compressor is in full-load operation, and at that moment, the compression system enters the three-cylinder operation mode, thereby achieving the adjustment to three-cylinder operation mode.

Optionally, the opening and/or closing of the first solenoid valve 4 and/or the second solenoid valve 5 is controlled according to the conditions of the unit load and the indoor and outdoor ambient temperature, thereby achieving the adjustment purpose of controlling the compression system to operate in two-cylinder or three-cylinder mode according to actual conditions by controlling the first and second solenoid valves based on the conditions of the unit load and the indoor and outdoor ambient temperature.

Figure 2:
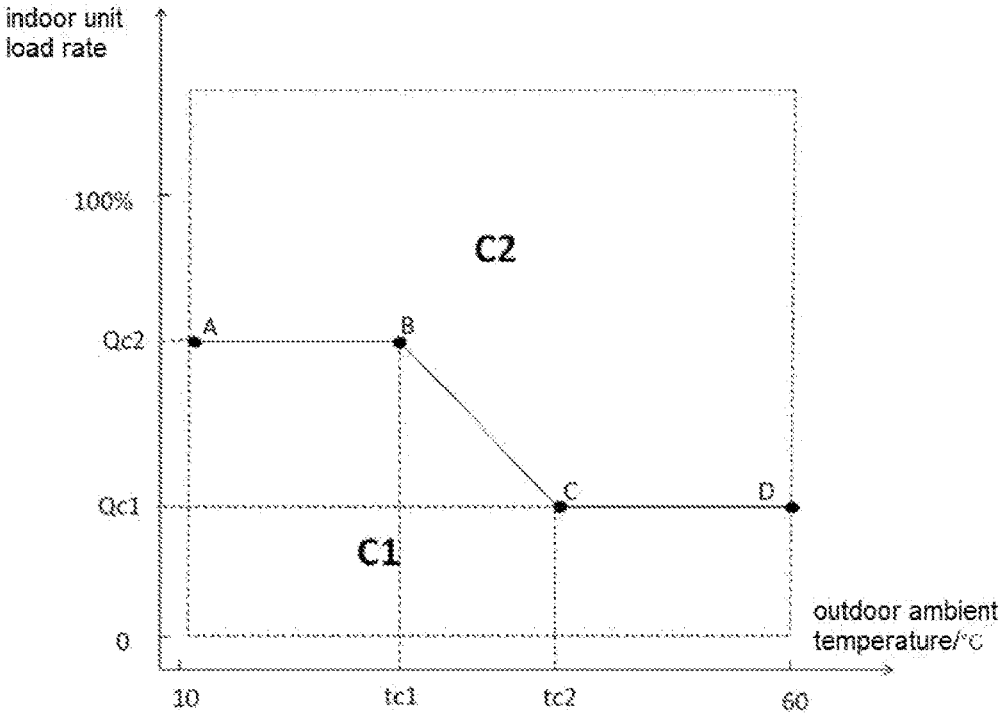
FIG. 2 is a refrigerating operation range and variable-capacity control diagram of the variable-capacity two-stage compression system in some embodiment of the present disclosure.

As shown in FIG. 2, optionally, when the system is in refrigerating operation, an operating action is performed after an outdoor ambient temperature and an indoor unit load rate are determined: when the outdoor ambient temperature and the indoor unit load are relatively low (at this time, there is a low requirement for capacity of the indoor unit), the first solenoid valve 4 is opened and the second solenoid valve 5 is closed, and at this time, the compressor operates in the two-cylinder mode; when the outdoor ambient temperature and the indoor unit load are relatively high (at this time, there is a high requirement for capacity of the indoor unit), the first solenoid valve 4 is closed and the second solenoid valve 5 is opened, and at this time, the compressor operates in a three-cylinder mode. Herein, whether it is relatively high or relatively low is determined by the following methods:

FIG. 2 is a unit's refrigerating operation range and variable-capacity control diagram, where the abscissa is the outdoor ambient temperature during refrigerating operation, and the ordinate is the indoor unit load rate.

Provided that the unit's refrigerating operation outdoor ambient temperature and load ranges are shown as the dashed box in FIG. 2, a line A-B-C-D (which is drawn based on the operating efficiency of the two-stage compression system) divides the unit's operation range into two zones, C1 and C2. In the zone C1, the outdoor ambient temperature is relatively lower, and the indoor unit load rate is relatively lower, which means that there is a lower requirement for capacity of the indoor unit, and at this time, the demand for the power of the compressor is relatively smaller; whereas in the zone C2, the outdoor ambient temperature is relatively higher, and the indoor unit load rate is relatively higher, which means that there is a higher requirement for capacity of the indoor unit, and at this time, the demand for the power of the compressor is relatively greater. Therefore, when the unit is operating stably, it may be required to determine the outdoor ambient temperature and the indoor unit load rate. When the outdoor ambient temperature and the indoor unit load are located within the zone C1, the first solenoid valve 4 is opened and the second solenoid valve 5 is closed, and at this time, the compressor operates in the two-cylinder mode. When the outdoor ambient temperature and the indoor unit load rate are located within the zone C2 or above the line A-B-C-D, the second solenoid valve 5 is opened and the first solenoid valve 4 is closed, and at this time, the compressor operates in the three-cylinder mode.

Figure 3:
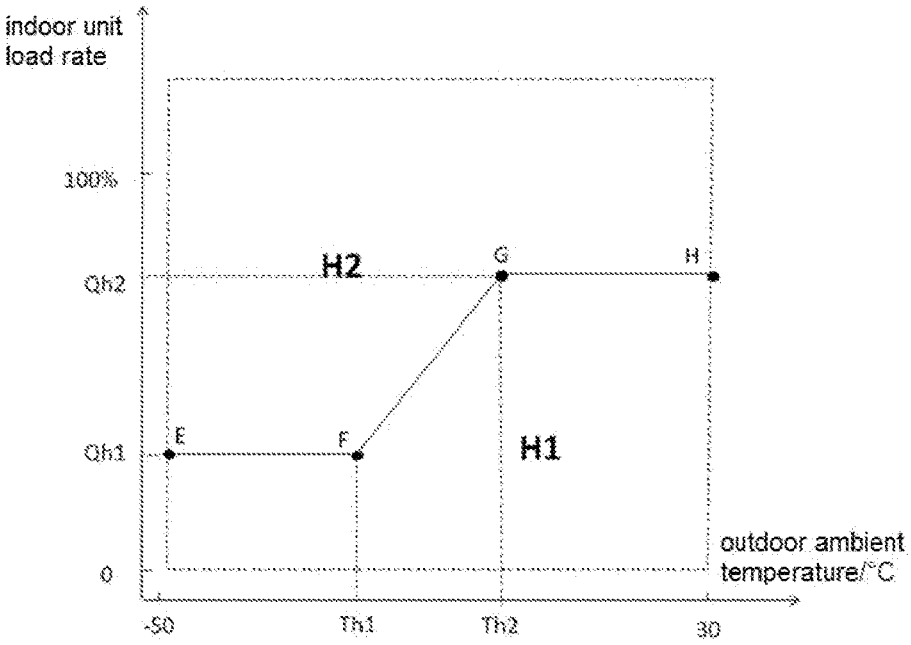
FIG. 3 is a heating operation range and variable-capacity control diagram of the variable-capacity two-stage compression system in some embodiment of the present disclosure.

As shown in FIG. 3, optionally, when the system is in heating operation, an operating action is performed after an outdoor ambient temperature and an indoor unit load rate are determined: when the outdoor ambient temperature is relatively higher and the indoor unit load rate is relatively lower (at this time, there is a lower requirement for capacity of the indoor unit), the first solenoid valve 4 is opened and the second solenoid valve 5 is closed, and at this time, the compressor operates in the two-cylinder mode; when the outdoor ambient temperature is relatively lower and the indoor unit load rate is relatively higher (at this time, there is a higher requirement for capacity of the indoor unit), the second solenoid valve 5 is opened and the first solenoid valve 4 is closed, and at this time, the compressor operates in the three-cylinder mode. Herein, whether it is relatively high or relatively low is determined by the following methods.

FIG. 3 is a unit's heating operation range and variable-capacity control diagram, where the abscissa is the outdoor ambient temperature during the heating operation, and the ordinate is the indoor unit load rate.

Provided that the unit's heating operation outdoor ambient temperature and load ranges are shown as the dashed box in FIG. 3, a line E-F-G-H (which is drawn based on the operating efficiency of the two-stage compression system) divides the unit's operating range into two zones, H1 and H2. In the zone H1, the outdoor ambient temperature is relatively higher, and the indoor unit load rate is relatively lower, which means that there is a lower requirement for capacity of the indoor unit, and at this time, the demand for the power of the compressor is relatively smaller; whereas in the zone H2, the outdoor ambient temperature is relatively lower, and the indoor unit load rate is relatively higher, which means that there is a higher requirement for capacity of the indoor unit, and at this time, the demand for the power of the compressor is relatively greater. Therefore, when the unit is operating stably, it may be required to determine the outdoor ambient temperature and the indoor unit load rate. When the outdoor ambient temperature and the indoor unit load are located within the zone H1, the first solenoid valve 4 is opened and the second solenoid valve 5 is closed, and at this time, the compressor operates in the two-cylinder mode. When the outdoor ambient temperature and the indoor unit load rate are located within the zone H2 or above the line E-F-G-H, the second solenoid valve 5 is opened and the first solenoid valve 4 is closed, and at this time, the compressor operates in the three-cylinder mode.

Embodiments of the present disclosure may adopt a variable-capacity two-stage compressor comprising three cylinders, wherein one of the cylinders (a third cylinder) is a high pressure cylinder, and two of the cylinders (a first cylinder and a second cylinder) are low pressure cylinders; the first cylinder and the second cylinder are connected in parallel, and the low pressure cylinder (the first cylinder and the second cylinder) and the high pressure cylinder (the third cylinder) are connected in series. The first cylinder can operate in two operation modes of no-load operation or full-load operation, while the second cylinder and the third cylinder always operate in full load.

When the first cylinder is no-loaded, of the low pressure stage, only the second cylinder is working, and a refrigerant passes through the second cylinder to be compressed before being mixed with an intermediate jet gas, and finally enters the third cylinder for second stage compression. At this time, the displacement ratio of the high pressure stage to the low pressure stage is relatively large, which is assumed to be "a"

herein. This operation mode is suitable for use in conditions with small load and is called two-cylinder mode.

When the first cylinder is fully-loaded, the first cylinder and the second cylinder in the low pressure stage are both working, and the refrigerant enters the first cylinder and the second cylinder from a gas-liquid separator respectively and then is mixed with the intermediate jet gas after being compressed by the lower pressure stage, i.e. the refrigerant after being compressed by the first cylinder and the second cylinder is mixed with the jet gas, and finally enters the high pressure cylinder, i.e. the third cylinder, for second stage compression. At this time, the displacement ratio of the high pressure stage to the low pressure stage is relatively small, which is assumed to be "b" herein. This operation mode is suitable for use in conditions with large load and is called three-cylinder mode.

This system achieves a variation in displacement ratio of the high pressure stage to the low pressure stage by adjusting the first cylinder in the low pressure stage of the compressor to perform in no-load and full-load operation, and switching of the first cylinder in the compressor between full-load and no-load needs to be controlled by the system pressure.

The switching of the first cylinder between the full-load and the no-load is specifically controlled by the following means.

In some embodiments, during operation of the unit, the first solenoid valve 4 is opened and the second solenoid valve 5 is closed, so that the first cylinder of the compressor is in no-load operation, and at this time, it is in the two-cylinder operation mode.

In some embodiments, during operation of the unit, the second solenoid valve 5 is opened and the first solenoid valve 4 is closed, so that the first cylinder of the compressor is in full-load operation, and at this time, it is in the three-cylinder operation mode.

The control on opening and closing of the first solenoid valve 4 and the second solenoid valve 5 is determined based on the conditions of the unit load and the indoor and outdoor ambient temperature. The control means are as follows.

Refrigerating Operation:

FIG. 2 is a unit's refrigerating operation range and variable-capacity control diagram, where the abscissa is the outdoor ambient temperature during the refrigerating operation, and the ordinate is the indoor unit load rate.

Provided that the unit's refrigerating operation outdoor ambient temperature and load ranges are shown as the dashed box in FIG. 2, a line A-B-C-D divides the unit's operation range into two zones, C1 and C2. In the zone C1, the outdoor ambient temperature is relatively lower, and the indoor unit load rate is relatively lower, which means that there is a lower requirement for capacity of the indoor unit, and at this time, the demand for the power of the compressor is relatively smaller; whereas in the zone C2, the outdoor ambient temperature is relatively higher, and the indoor unit load rate is relatively higher, which means that there is a higher requirement for capacity of the indoor unit, and at this time, the demand for the power of the compressor is relatively greater. Therefore, when the unit is operating stably, it may be required to determine the outdoor ambient temperature and the indoor unit load rate. When the outdoor ambient temperature and the indoor unit load are located within the zone C1, the first solenoid valve 4 is opened and the second solenoid valve 5 is closed, and at this time, the compressor operates in the two-cylinder mode. When the outdoor ambient temperature and the indoor unit load rate are located within the zone C2 or above the line A-B-C-D, the second solenoid valve 5 is opened and the first solenoid valve 4 is closed, and at this time, the compressor operates in the three-cylinder mode.

FIG. 3 is a unit's heating operation range and variable-capacity control diagram, where the abscissa is the outdoor ambient temperature during the heating operation, and the ordinate is the indoor unit load rate.

Provided that unit's heating operation outdoor ambient temperature and load ranges are shown as the dashed box in FIG. 3, a line E-F-G-H divides the unit's operation range into two zones, H1 and H2. In the zone H1, the outdoor ambient temperature is relatively higher, and the indoor unit load rate is relatively lower, which means that there is a lower requirement for capacity of the indoor unit, and at this time, the demand for the power of the compressor is relatively smaller; whereas in the zone H2, the outdoor ambient temperature is relatively lower, and the indoor unit load rate is relatively higher, which means that there is a higher requirement for capacity of the indoor unit, and at this time, the demand for the power of the compressor is relatively greater. Therefore, when the unit is operating stably, it may be required to determine the outdoor ambient temperature and the indoor unit load rate. When the outdoor ambient temperature and the indoor unit load rate are located within the zone H1, the first solenoid valve 4 is opened and the second solenoid valve 5 is closed, and at this time, the compressor operates in the two-cylinder mode. When the outdoor ambient temperature and the indoor unit load rate are located within the zone H2 or above the line E-F-G-H, the second solenoid valve 5 is opened and the first solenoid valve 4 is closed, and at this time, the compressor operates in the three-cylinder mode.

Embodiments of the variable-capacity two-stage compression system and the control method thereof are beneficial in that:

1. A variable-capacity two-stage compression system of the present disclosure can achieve a variation in displacement ratio of the high pressure stage to the low pressure stage in a single compressor, has a small variation in energy efficiency, can simultaneously meet the energy efficiency requirements for refrigeration and heating, and greatly improves the economic performance of the system;

2. A variable-capacity two-stage compression system of the present disclosure is simpler and less costly than a system in which two compressors are connected in series, and is free of the problem that two compressors are oil imbalanced. Moreover, the operating temperature range and operating efficiency of the system can be increased, and the reliability of the two-stage compression system can be improved as well, thereby greatly improving the economic performance of the two-stage compression system.

Those skilled in the art can easily appreciate that the above advantageous modes can be freely combined and superposed without conflict.

The foregoing is intended only as preferred embodiments of the present disclosure, but is not used for limiting the present disclosure. Any amendment, equivalent replacement, improvement, and the like within the spirit and principles of the present disclosure should all be contained within the protection scope of the present disclosure. The aforementioned only pertains to preferred embodiments of the present disclosure. It should be set forth that, for a common technical person in the art, on the premise of not departing away from the technical principles of the present disclosure, several improvements and modifications may also be made to the present disclosure, and such modifications and modifications should also be deemed as the protection scope of the present disclosure.

What is claimed is:

1. A variable-capacity two-stage compression system, comprising:

a variable-capacity compressor, comprising a low pressure cylinder comprising at least two cylinders connected in parallel and a high pressure cylinder in serial connection with the low pressure cylinder; and a control mechanism configured to control at least one of the at least two cylinders connected in parallel to operate in full-load or no-load operation, wherein the control mechanism comprises a first solenoid valve and a second solenoid valve, in the case where the system needs to operate in two-cylinder mode, the first solenoid valve is opened and the second solenoid valve is closed, so that the first cylinder of the compressor operates in no-load and the compression system enters the two-cylinder operation mode.

2. The variable-capacity two-stage compression system of claim 1, wherein the control mechanism comprises:

a pipeline structure communicating with a suction port of the low pressure cylinder.

3. The variable-capacity two-stage compression system of claim 2, wherein when the low pressure cylinder comprises a first cylinder and a second cylinder, the pipeline structure comprises a first pipeline that communicates with a suction port of the first cylinder, and a second pipeline that communicates with a suction port of the second cylinder.

4. The variable-capacity two-stage compression system of claim 3, wherein:

the first solenoid valve is disposed on the first pipeline; and the second solenoid valve is disposed on the second pipeline.

5. A variable-capacity two-stage compression control method, comprising: performing variable-capacity two-stage compression control and adjustment to the variable-capacity two-stage compression system of claim 1 by means of a control mechanism thereof.

6. The variable-capacity two-stage compression control method of claim 5, wherein in the case where the system needs to operate in three-cylinder mode, the second solenoid valve is opened and the first solenoid valve is closed, so that the first cylinder of the compressor operates in full-load and the compression system enters the three-cylinder operation mode.

7. The variable-capacity two-stage compression control method of claim 5, wherein the opening and/or closing of at least one of the first solenoid valve or the second solenoid valve is controlled according to conditions of unit load and indoor and outdoor ambient temperature.

8. The variable-capacity two-stage compression control method of claim 7, comprising when the system is in refrigerating operation:

determining the outdoor ambient temperature and an indoor unit load rate;

opening the first solenoid valve and closing the second solenoid valve if the outdoor ambient temperature and the indoor unit load are relatively low, so that the compressor operates in the two-cylinder mode;

opening the second solenoid valve and closing the first solenoid valve if the outdoor ambient temperature and the indoor unit load are relatively high, so that the compressor operates in a three-cylinder mode.

9. The variable-capacity two-stage compression control method of claim 7, comprising when the system is in heating operation:

determining the outdoor ambient temperature and an indoor unit load rate;

opening the first solenoid valve and closing the second solenoid valve if the outdoor ambient temperature is relatively high and the indoor unit load rate is relatively low, the first solenoid valve is opened and the second solenoid valve is closed, so that the compressor operates in the two-cylinder mode;

opening the second solenoid valve and closing the first solenoid valve if the outdoor ambient temperature is relatively low and the indoor unit load rate is relatively high, so that the compressor operates in a three-cylinder mode.

10. A variable-capacity two-stage compression system, comprising:

a variable-capacity compressor, comprising a low pressure cylinder comprising at least two cylinders connected in parallel and a high pressure cylinder in serial connection with the low pressure cylinder; and a control mechanism configured to control at least one of the at least two cylinders connected in parallel to operate in full-load or no-load operation, in the case where the system needs to operate in a three-cylinder mode, a second solenoid valve is opened and a first solenoid valve is closed, so that the first cylinder of the compressor operates in full-load and the compression system enters the three-cylinder mode.

11. The variable-capacity two-stage compression system of claim 10, wherein in the case where the system needs to operate in two-cylinder mode, the first solenoid valve is opened and the second solenoid valve is closed, so that the first cylinder of the compressor operates in no-load and the compression system enters the two-cylinder mode.

12. A variable-capacity two-stage compression control method, comprising: performing variable-capacity two-stage compression control and adjustment to the variable-capacity two-stage compression system of claim 10 by means of a control mechanism thereof.

* * * * *